US011272825B2

(12) United States Patent
Wahlberg et al.

(10) Patent No.: US 11,272,825 B2
(45) Date of Patent: Mar. 15, 2022

(54) DISHWASHER

(71) Applicant: ELECTROLUX APPLIANCES AKTIEBOLAG, Stockholm (SE)

(72) Inventors: Magnus Wahlberg, Stockholm (SE); Finn Svensson, Stockholm (SE); David Persson, Stockholm (SE); Camilla Runnquist, Stockholm (SE); Maciej Zienkiewicz, Stockholm (SE); David Hedberg, Stockholm (SE); John Anello, Stockholm (SE)

(73) Assignee: Electrolux Appliances Aktiebolag

( * ) Notice: Subject to any disclaimer, the term of this patent is extended or adjusted under 35 U.S.C. 154(b) by 61 days.

(21) Appl. No.: 16/466,667

(22) PCT Filed: Dec. 15, 2016

(86) PCT No.: PCT/EP2016/081263

§ 371 (c)(1),
(2) Date: Jun. 5, 2019

(87) PCT Pub. No.: WO2018/108285

PCT Pub. Date: Jun. 21, 2018

(65) Prior Publication Data

US 2019/0290095 A1 Sep. 26, 2019

(51) Int. Cl.

| | |
|---|---|
| ***A47L 15/23*** | (2006.01) |
| ***A47L 15/00*** | (2006.01) |
| ***A47L 15/42*** | (2006.01) |

(52) U.S. Cl.

CPC ..... *A47L 15/23* (2013.01); *A47L 15/0063* (2013.01); *A47L 15/4289* (2013.01);
(Continued)

(58) Field of Classification Search

CPC .. A47L 15/23; A47L 15/0063; A47L 15/4289; A47L 2501/05; A47L 2301/08;
(Continued)

(56) References Cited

U.S. PATENT DOCUMENTS

| | | | | |
|---|---|---|---|---|
| 5,017,852 | A | 5/1991 | Nagata | |
| 2012/0097199 | A1* | 4/2012 | Tuller | A47L 15/4221 134/56 D |
| 2013/0125937 | A1* | 5/2013 | Baldwin | A47L 15/486 134/56 D |

FOREIGN PATENT DOCUMENTS

| | | |
|---|---|---|
| DE | 10 2006 007329 A1 | 8/2007 |
| DE | 10 2014 205266 A1 | 9/2016 |

(Continued)

OTHER PUBLICATIONS

International Search Report and Written Opinion for Application No. PCT/EP2016/081263 dated Mar. 1, 2017, 11 pages.

(Continued)

*Primary Examiner* — Michael E Barr
*Assistant Examiner* — Pallavi Chitta
(74) *Attorney, Agent, or Firm* — RatnerPrestia

(57) ABSTRACT

A dishwasher may include a washing chamber and a wash arm arrangement having a wash arm rotatably arranged in the washing chamber, and a satellite spray device arranged on the wash arm. The dishwasher may include at least one sensor configured to sense a rotational position of the wash arm and a control unit configured to monitor consecutive sensed rotational positions of the wash arm. The control unit may be configured to calculate a rotational speed of the wash arm based on an elapsed time and a rotational distance between two sensed rotational positions, and may be configured to estimate a current rotational position of the wash arm based on an elapsed time since a previously sensed rotational position and the calculated rotational speed. The control unit may adapt the pumping intensity of a pump of the dishwasher based on the estimated current rotational position of the wash arm.

18 Claims, 2 Drawing Sheets

(52) U.S. Cl.
CPC ..... *A47L 2301/08* (2013.01); *A47L 2401/24* (2013.01); *A47L 2401/30* (2013.01); *A47L 2401/32* (2013.01); *A47L 2501/04* (2013.01); *A47L 2501/05* (2013.01)

(58) Field of Classification Search
CPC ..... A47L 2401/24; A47L 2401/30; A47L 2401/32; A47L 2501/04
See application file for complete search history.

(56) References Cited

FOREIGN PATENT DOCUMENTS

| | | | | | |
|---|---|---|---|---|---|
| EP | 1 252 856 | A2 | | 10/2002 | |
| EP | 2 706 138 | A1 | | 3/2014 | |
| JP | 08237986 | A | | 9/1996 | |
| JP | 08299248 | A | | 11/1996 | |
| JP | 2008228813 | A | | 10/2008 | |
| JP | 2009 273490 | A | | 11/2009 | |
| JP | 4532513 | B2 | * | 8/2010 | |
| WO | WO 2015/090461 | A1 | | 6/2015 | |
| WO | WO-2015090460 | A1 | * | 6/2015 | ..... A47L 15/4214 |
| WO | WO-2015090461 | A | * | 6/2015 | ..... A47L 15/4214 |
| WO | WO 2016/096020 | A1 | | 6/2016 | |

OTHER PUBLICATIONS

Chinese Office Action for Chinese Application No. 201680091403.9, dated Dec. 28, 2021, 10 pages.

* cited by examiner

DISHWASHER

CROSS-REFERENCE TO RELATED APPLICATIONS

This application is a national stage application filed under 35 U.S.C. § 371 of International Application No. PCT/EP2016/081263 filed Dec. 15, 2016, which application is hereby incorporated by reference herein in its entirety.

TECHNICAL FIELD

The present invention relates to a dishwasher comprising a control unit configured to adapt pumping intensity of a pump of the dishwasher based on an estimated current rotational position of a wash arm of the dishwasher.

BACKGROUND

A dishwasher is an apparatus for washing items by using a force of washing liquid sprayed onto the items. Today's dishwashers are expected to manage simultaneous washing of various types of items including delicate items such as wine glasses, champagne glasses, painted tableware, etc., as well as heavily soiled items such as pots and pans. Heavily soiled items, such as pots and pans, require much higher washing power to become clean than delicate items such as wine glasses, champagne glasses and painted tableware. Further, a too high washing power may damage such delicate items. In addition, environmental concerns require an efficient use of water and energy during a wash session. The requirements of performing high quality wash of items of various types, and the efficient use of water and energy during a wash session, can be seen as conflicting requirements. In addition, on the consumer market, it is an advantage if high quality products can be provided in a cost-efficient manner.

The document EP1252856A2 relates to a method involving operation of a rotating spray arm with increased spraying pressure as it passes the corner regions of a rectangular cleaning chamber compared to the normal spraying pressure. A sensor and evaluation device determines the time at which the spray arm is pointing to the corner region and at which increased spraying pressure is to be used. The method proposed in the document EP1252856A2 does not solve the above-mentioned problems and conflicting requirements.

In view of above, there is a need for a dishwasher capable of solving at least some of the above described problems and conflicting requirements.

SUMMARY

It is an object of the present invention to a provide a dishwasher with improved controllability of washing power in areas of a washing chamber of the dishwasher.

According to an aspect of the invention, the object is achieved by a dishwasher comprising a washing chamber, and a wash arm arrangement comprising a wash arm rotatably arranged in the washing chamber, and a satellite spray device arranged on the wash arm. The wash arm arrangement is provided with a plurality of nozzles. The dishwasher comprises a pump fluidically connected to the plurality of nozzles. The pump is configured to pump washing liquid through the plurality of nozzles into the washing chamber. The dishwasher comprises at least one sensor configured to sense a rotational position of the wash arm. The dishwasher further comprises a control unit configured to monitor consecutive sensed rotational positions of the wash arm, wherein the control unit is configured to calculate a rotational speed of the wash arm based on an elapsed time and a rotational distance, between two sensed rotational positions and configured to estimate a current rotational position of the wash arm based on an elapsed time since a previously sensed rotational position and the calculated rotational speed. The control unit is further configured to adapt pumping intensity of the pump based on the estimated current rotational position of the wash arm.

Since the control unit is configured to estimate the current rotational position of the wash arm based on an elapsed time since a previously sensed rotational position and the calculated rotational speed, a simple and reliable estimation of the current rotational position of the wash arm is provided. Since the wash arm comprises a satellite spray device, controllability of washing power is further improved in comparison to a dishwasher comprising a traditional straight wash arm, since a flowrate of washing liquid from a traditional straight wash arm is essentially evenly distributed between two opposite portions on a respective side of an axis of rotation of the wash arm, in contrast to a wash arm arrangement comprising a satellite spray device. Thus, by adapting the pumping intensity of the pump based on the estimated current rotational position of the wash arm comprising the satellite spray device, controllability of washing power in areas of the washing chamber is improved.

Accordingly, the above mentioned object is achieved.

Optionally, at least one nozzle of the plurality of nozzles is arranged to direct the washing liquid in directions causing the wash arm to rotate within the washing chamber. Since the control unit is configured to estimate the current rotational position of the wash arm based on an elapsed time since a previously sensed rotational position and the calculated rotational speed, a dishwasher is provided capable of estimating the current rotational position of the wash arm also in embodiments where rotation of the wash arm is caused by washing liquid being directed from the at least one nozzle. Thus, a dishwasher is provided capable of estimating the current rotational position of the wash arm even in embodiments where no mechanical connection exists between the wash arm and a motor configured to rotate the wash arm.

Optionally, the wash arm is configured to continuously rotate within the washing chamber when the pump is pumping washing liquid through the at least one nozzle. Thereby, a dishwasher is provided with improved controllability of washing power without having to stop the rotation of the wash arm at certain positions within the wash chamber. Thus, a simple, effective and reliable adaptation of pumping intensity, and thus also adaptation of washing power, is provided.

Optionally, the satellite spray device is rotatably arranged around a satellite spray device axis on the wash arm, and wherein nozzles of the satellite spray device are arranged to direct the washing liquid in directions causing the satellite spray device to rotate around the satellite spray device axis. Thereby, during operation, the satellite spray device will rotate around the satellite spray device axis and will thereby evenly distribute washing liquid in different directions in the area covered by the satellite spray device. Further, the rotation of the satellite spray device is provided in a simple and reliable manner.

Optionally, the number of nozzles and/or sizes of nozzles on the satellite spray device and the wash arm are arranged such that a flowrate of washing liquid pumped through the nozzles of the satellite spray device is higher than a flowrate of washing liquid pumped through the nozzles of the wash arm. Thereby, controllability of washing power is even further improved since flowrate of washing liquid pumped to different areas of the dishwasher can be adapted to a higher degree.

Optionally, the wash arm comprises a magnet and the at least one sensor comprises at least one magnetic sensor configured to sense the rotational position of the wash arm by sensing a magnetic field of the magnet. Thereby, a simple and reliable sensor for sensing the rotational position of the wash arm is provided which can be provided at a low cost.

Optionally, the dishwasher comprises one sensor only, configured to sense a rotational position of the wash arm. Thereby, a simple and reliable sensor is provided which can be provided at a low cost. Still, since the control unit is configured to estimate the current rotational position of the wash arm based on an elapsed time since a previously sensed rotational position and the calculated rotational speed, a sufficiently reliable estimation is provided of the current rotational position of the wash arm in a full rotational range of the wash arm.

Optionally, the control unit is configured to increase or decrease pumping intensity of the pump when the estimated current rotational position is within at least one selected rotational position interval. Thereby, a dishwasher is provided in which controllability of washing power is even further improved Optionally, the dishwasher comprises a user interface for selecting the at least one selected rotational position interval. Thereby, a dishwasher is provided which offers selection of the at least one selected rotational position interval in a user-friendly manner.

Optionally, the dishwasher comprises a first communication unit connected to the control unit, wherein the first communication unit is arranged to wirelessly communicate with a second communication unit comprising a user interface for selecting the at least one selected rotational position interval. Thereby, a dishwasher is provided which offers selection of the at least one selected rotational position interval in an even more user-friendly manner since the dishwasher allows selection of the at least one rotational position interval from a unit which may be separated from the dishwasher. Thus, according to these embodiments, the selection of the at least one rotational position interval can be performed at a distance from the dishwasher.

Optionally, the second communication unit is a stationary or portable communication unit, such as a computer, a tablet computer or a smartphone. Thus, according to these embodiments, a user may select the at least one rotational position interval from a unit that the user already possesses. Accordingly, a dishwasher is provided which offers selection of the at least one selected rotational position interval in an even more user-friendly manner, while keeping manufactory costs of the dishwasher low.

Further features of, and advantages with, the present invention will become apparent when studying the appended claims and the following detailed description.

BRIEF DESCRIPTION OF THE DRAWINGS

Various aspects of the invention, including its particular features and advantages, will be readily understood from the example embodiments discussed in the following detailed description and the accompanying drawings, in which.

DETAILED DESCRIPTION

Aspects of the present invention will now be described more fully. Like numbers refer to like elements throughout. Well-known functions or constructions will not necessarily be described in detail for brevity and/or clarity.

Figure 1:
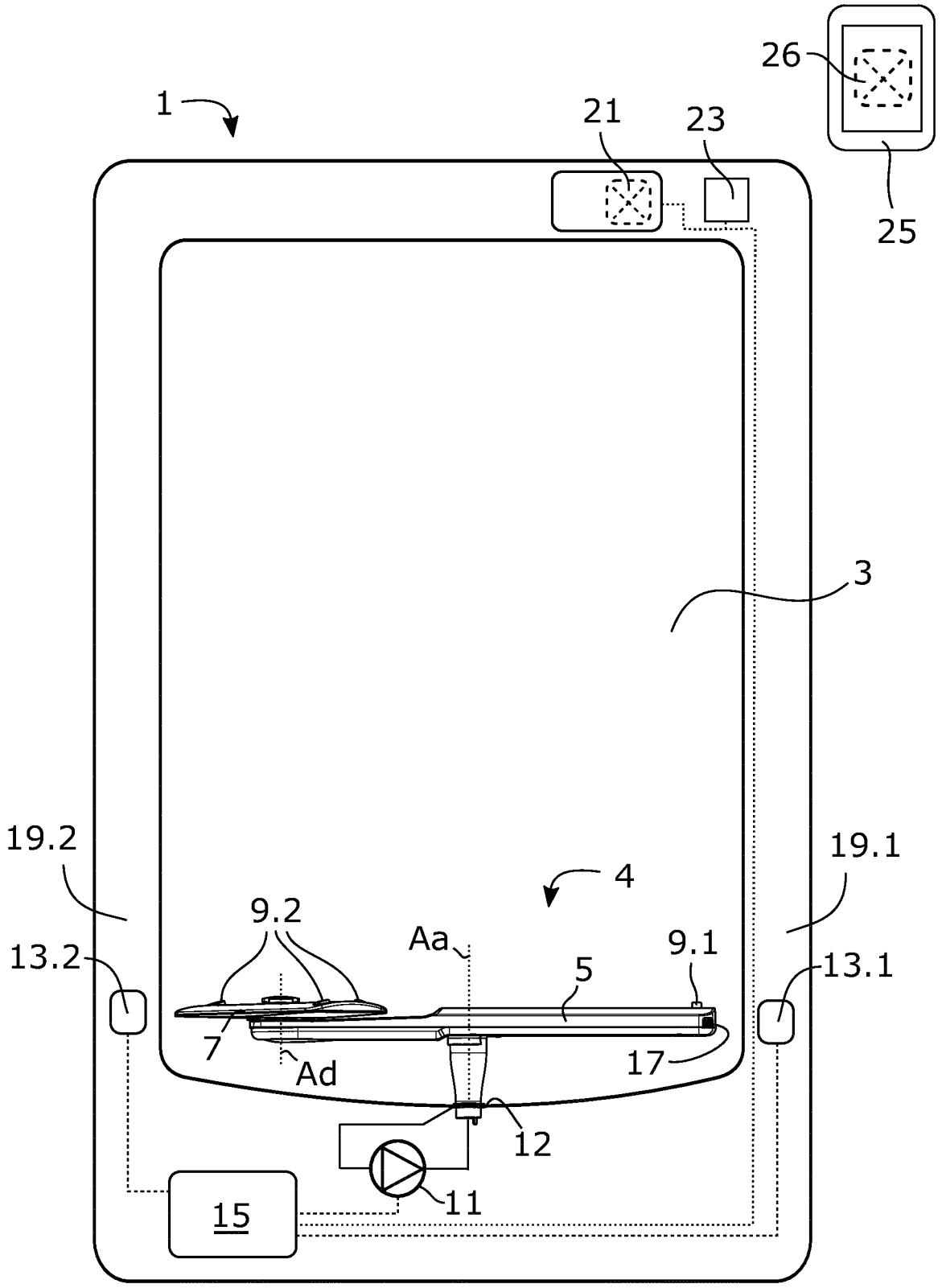
FIG. 1 illustrates a dishwasher according to some embodiments.

FIG. 1 illustrates a dishwasher 1 comprising a washing chamber 3, and a wash arm arrangement 4 comprising a wash arm 5 rotatably arranged around a wash arm axis Aa in the washing chamber 3. The washing chamber 3 is configured to accommodate racks for holding items to be washed within the washing chamber 3. For clarity reasons, such racks and items to be washed are not illustrated in FIG. 1. Likewise, the dishwasher 1 comprises a dishwasher door pivotally arranged at the dishwasher 1 to allow access to the washing chamber 3 and to provide a closing surface of the washing chamber 3. The dishwasher door is not illustrated in FIG. 1 for clarity reasons. The wash arm arrangement 4 comprises a satellite spray device 7 arranged on the wash arm 5. According to the embodiments illustrated in FIG. 1, the satellite spray device 7 is rotatably arranged around a satellite spray device axis Ad on the wash arm 5. The wash arm arrangement 4 is provided with a plurality of nozzles 9.1, 9.2. The dishwasher 1 comprises a pump 11 fluidically connected to the plurality of nozzles 9.1, 9.2 and a sump 12 of the wash chamber 3, wherein the pump 11 is configured to pump washing liquid from the sump 12 through the plurality of nozzles 9.1, 9.2 into the washing chamber 3 and onto items to be washed placed in the washing chamber 3. The washing liquid may comprise water, or a mixture of water, detergent and/or softener. When the washing liquid has been sprayed into the washing chamber 3 and onto the items to be washed, the washing liquid is collected in the sump 12 and subsequently pumped again through the plurality of nozzles 9.1, 9.2 into the washing chamber 3.

In the embodiments illustrated in FIG. 1, the dishwasher 1 comprises a first sensor 13.1 and a second sensor 13.2. The first sensor 13.1 and the second sensor 13.2 are configured to sense a rotational position of the wash arm 5. Thus, according to the illustrated embodiments, the dishwasher 1 comprises two sensors 13.1, 13.2 configured to sense a rotational position of the wash arm 5. However, the dishwasher 1 may comprise another number of sensors configured to sense a rotational position of the wash arm 5, such as one, three, four, five or six sensors. In the embodiments illustrated in FIG. 1, the first and second sensors 13.1, 13.2 are arranged at washing chamber walls 19.1, and 19.2. However, the dishwasher 1 may comprise one or more sensors arranged at another position of the dishwasher, such as at a bottom of the washing chamber 3.

The dishwasher 1 further comprises a control unit 15 connected to the first and second sensors 13.1, 13.2. The control unit 15 is configured to monitor consecutive sensed rotational positions of the wash arm 5 during rotation of the wash arm 5. The control unit 15 is configured to calculate a rotational speed of the wash arm 5 based on an elapsed time and a rotational distance, between two sensed rotational positions and configured to estimate a current rotational position of the wash arm 5 based on an elapsed time since a previously sensed rotational position and the calculated rotational speed. Thereby, a current rotational position of the wash arm 5 is provided in a simple and effective manner. A previously sensed rotational position of the wash arm 5 may comprise a last sensed rotational position of the wash arm 5.

In the embodiments illustrated in FIG. 1, where the dishwasher 1 comprises a first sensor 13.1 and a second sensor 13.2 oppositely arranged on a respective side of the wash arm axis Aa, the rotational distance between two sensed rotational positions is half a revolution of the wash arm 5 around the wash arm axis Aa.

The control unit 15 is further connected to the pump 11 and is configured to adapt pumping intensity of the pump 11 based on the estimated current rotational position of the wash arm 5. Thereby, pumping intensity, and thus also washing power, is adapted such that the washing power is different in different areas of the dishwasher. Since the wash arm 5 comprises a satellite spray device 7, controllability of washing power is further improved in comparison to a dishwasher comprising a traditional straight wash arm.

The control unit 15 may comprise a calculation unit which may take the form of substantially any suitable type of processor circuit or microcomputer, e.g. a circuit for digital signal processing (digital signal processor, DSP), a Central Processing Unit (CPU), a processing unit, a processing circuit, a processor, an Application Specific Integrated Circuit (ASIC), a microprocessor, or other processing logic that may interpret and execute instructions. The herein utilised expression "calculation unit" may represent a processing circuitry comprising a plurality of processing circuits, such as, e.g., any, some or all of the ones mentioned above. The control unit 15 may comprise a memory unit. The calculation unit may be connected to the memory unit, which provides the calculation unit with, for example, the stored programme code and/or stored data which the calculation unit needs to enable it to do calculations. The calculation unit may also be adapted to store partial or final results of calculations in the memory unit. The memory unit may comprise a physical device utilised to store data or programs, i.e., sequences of instructions, on a temporary or permanent basis. According to some embodiments, the memory unit may comprise integrated circuits comprising silicon-based transistors. The memory unit may comprise e.g. a memory card, a flash memory, a USB memory, a hard disc, or another similar volatile or non-volatile storage unit for storing data such as e.g. ROM (Read-Only Memory), PROM (Programmable Read-Only Memory), EPROM (Erasable PROM), EEPROM (Electrically Erasable PROM), etc. in different embodiments.

Figure 2A:
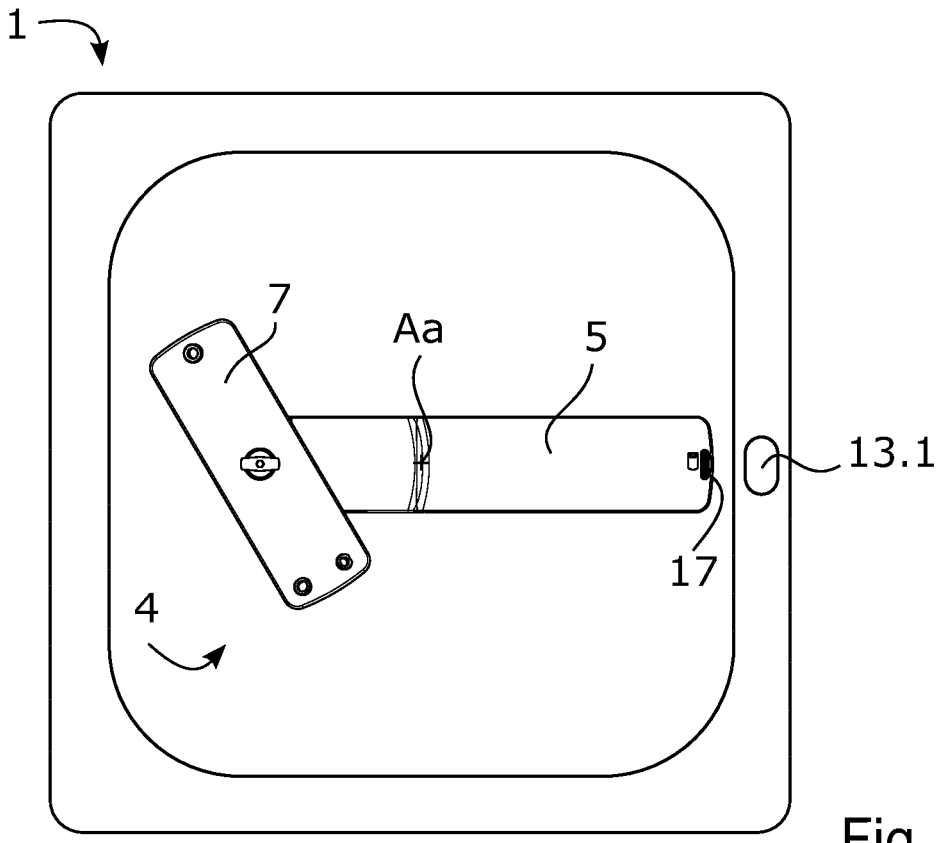
FIG. 2*a* and FIG. 2*b* illustrate a cross section of a dishwasher according to some embodiments.
Figure 2B:
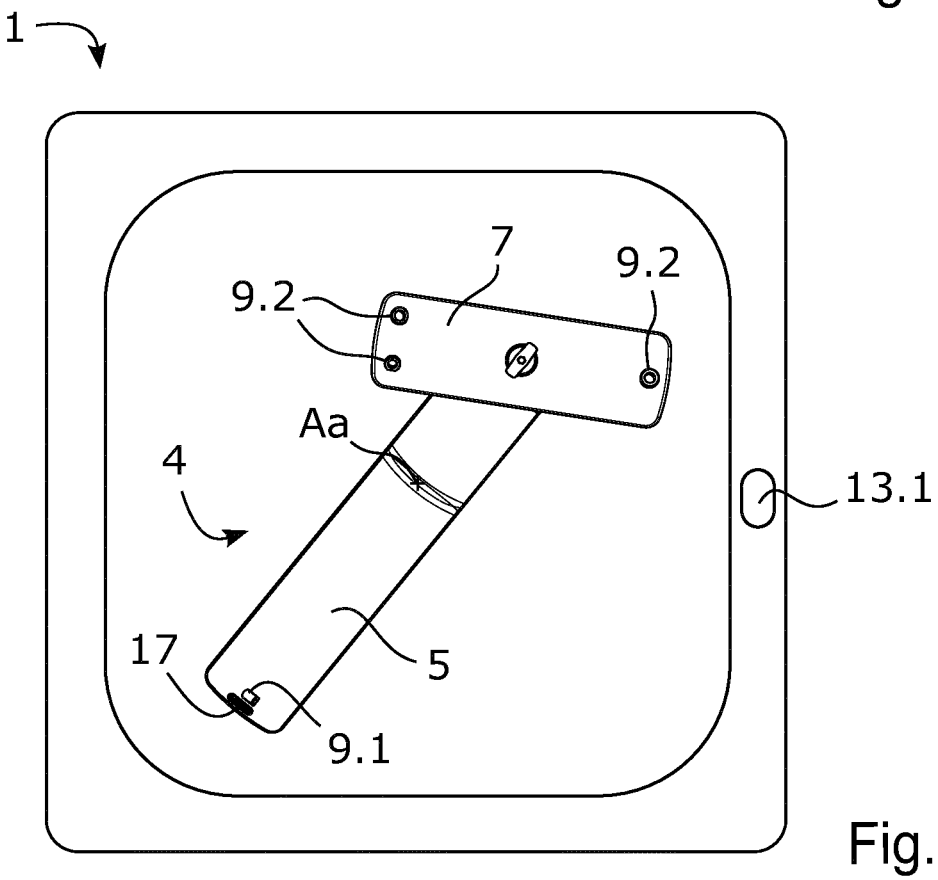

FIG. 2*a* and FIG. 2*b* illustrate a cross section of a dishwasher 1 according to some embodiments. The wash arm arrangement 4 is illustrated as being seen from above in these cross sections. The dishwasher 1 illustrated in FIG. 2*a* and FIG. 2*b* comprises the same features as the dishwasher 1 illustrated in FIG. 1, except that the dishwasher 1 illustrated in FIG. 2*a* and FIG. 2*b* comprises one sensor 13.1 only, configured to sense a rotational position of the wash arm 5.

According to the embodiments illustrated in FIG. 2*a* and FIG. 2*b*, the wash arm 5 comprises a magnet 17 arranged at a first end of the wash arm 5 and the sensor 13.1 comprises a magnetic sensor. The magnetic sensor is configured to sense the rotational position of the wash arm 5 by sensing a magnetic field of the magnet 17. The magnetic sensor may be referred to as a magnetic field sensor and may for example operate by detecting effects of the Lorentz force, a change in voltage or resonant frequency, or a mechanical displacement of a body having magnetic properties. Examples of magnetic sensors are hall effect sensors, magneto-diodes, and magneto-transistors.

According to the illustrated embodiments, the magnet 17 is arranged at the first end of the wash arm 5 and the satellite spray device 7 is arranged at a second end of the wash arm 5, wherein the second end of the wash arm 5 is opposite to the first end. Due to this arrangement, sensing of the rotational position of the wash arm 5 is provided in a reliable manner since the magnet 17 will be at a same distance in relation to the sensor 13.1 during each revolution of the wash arm 5, when the wash arm 5 is in the position as illustrated in FIG. 2*a*. In FIG. 2*a*, the wash arm 5 is illustrated in a position where the magnet 17 faces the sensor 13.1. In this position, the sensor 13.1 senses the rotational position of the wash arm 5.

In FIG. 2*b*, the wash arm 5 has rotated to a position in which magnet 17 is at a greater distance from the sensor 13.1. In this position, the sensor 13.1 is unable to sense the rotational position of the wash arm 5. Instead the control unit 15 estimates a current rotational position of the wash arm 5 based on an elapsed time since a previously sensed rotational position and the calculated rotational speed. Thereby, a current rotational position of the wash arm is provided in a simple and effective manner.

In the illustrated embodiments, the rotational distance between two sensed rotational positions is one revolution of the wash arm 5 around the wash arm axis Aa. As an example, if the elapsed time between two sensed rotational positions is 6 seconds, i.e. if the elapsed time during one revolution of the wash arm 5 illustrated in FIG. 2*a* and FIG. 2*b* is 6 seconds, the rotational speed of the wash arm 5 will be calculated to 10 revolutions per minute. As a further example, in embodiments where the dishwasher 1 comprises a first sensor 13.1 and a second sensor 13.2 configured to sense the rotational position of the wash arm 5, as is illustrated in FIG. 1, the rotational distance between two sensed rotational positions is half a revolution of the wash arm 5. If the elapsed time between two sensed rotational positions, i.e. the elapsed time during half a revolution, is 3 seconds the rotational speed of the wash arm 5 will also be calculated to 10 revolutions per minute.

As mentioned, the control unit is configured to estimate a current rotational position of the wash arm 5 based on an elapsed time since a previously sensed rotational position and the calculated rotational speed. The position of the wash arm 5 illustrated in FIG. 1 can be said to represent a previously sensed rotational position. If the elapsed time between two sensed rotational positions is 6 second in the illustrated embodiments, and two seconds have elapsed since the previous sensed rotational position, the control unit will estimate the current rotational position of the wash arm 5 to a position as is illustrated in FIG. 2*b*, i.e. a position where the wash arm 5 has rotated a third of a revolution around the wash arm axis Aa.

The wash arm arrangement 4 is provided with a plurality of nozzles 9.1, 9.2. In the illustrated embodiments, the wash arm 5 comprises a nozzle 9.1 arranged to direct the washing liquid in directions causing the wash arm 5 to rotate within the washing chamber 3. The directions are essentially opposite to the direction of rotation of the wash arm 5. The wash arm 5 is configured to continuously rotate within the washing chamber 3 when the pump 11 is pumping washing liquid through the at least one nozzle 9.1 of the wash arm 5. According to some embodiments, the wash arm 5 is configured to continuously rotate within the washing chamber 3 when the pump 11 is pumping washing liquid through the at least one nozzle 9.1 of the wash arm 5 with a pumping intensity exceeding a pumping intensity threshold value, wherein the control unit 15 is configured to keep the pumping intensity of the pump 11 above the pumping intensity threshold value during a wash session of the dishwasher 1.

Further, in the illustrated embodiments, the nozzles 9.2 of the satellite spray device 7 are arranged to direct the washing liquid in directions causing the satellite spray device 7 to rotate around the satellite spray device axis Ad. The directions are essentially opposite to the direction of rotation of the satellite spray device 7.

The number of nozzles 9.1, 9.2 and/or sizes of nozzles 9.1, 9.2 on the satellite spray device 7 and the wash arm 5 are arranged such that a flowrate of washing liquid pumped through the nozzles 9.2 of the satellite spray device 7 is higher than a flowrate of washing liquid pumped through the nozzles 9.1 of the wash arm 5. Thereby, controllability of washing power is even further improved since flowrate of washing liquid pumped to different areas of the dishwasher can be controlled to a higher degree.

The control unit 15 may be configured to increase or decrease pumping intensity of the pump 11 when the estimated current rotational position is within at least one selected rotational position interval. The dishwasher 1 may comprise a user interface 21 for selecting the at least one selected rotational position interval and for selecting whether an increase or decrease of pumping intensity is to be performed within the at least one selected rotational position interval, as well as a level of such an increase or such a decrease of the pumping intensity to be performed within the at least one selected rotational position interval. The estimated current rotational position of the wash arm 5 may encompass an estimated current rotational position of the satellite spray device 7 where the control unit 15 is configured to adapt pumping intensity of the pump 11 based on the estimated current rotational position of the satellite spray device 7. That is, in the embodiments illustrated in FIGS. 2*a* and 2*b*, in which the sensor 13.1 senses the rotational position of the wash arm 5 by sensing a magnetic field of a magnet 17 arranged at a first end of the wash arm 5, being opposite to the second end of the wash arm 5 at which the satellite spray device 7 is arranged, the control unit estimates the current rotational position of the satellite spray device 7 to a position essentially half a revolution away from the position of the sensed magnetic field of the magnet 17 and adapts the estimation of the satellite spray device 7 on the basis thereof.

As an example, if a user has placed a heavily soiled item at a position in the wash chamber corresponding to the position of the satellite spray device 7 illustrated in FIG. 2*b*, the user may select a rotational position interval corresponding to the position of the heavily soiled item and select an increase of pumping intensity in the rotational position interval. In response thereto, the control unit will increase pumping intensity when the estimated current rotational position of the satellite spray device 7 is within the selected rotational position interval and as a result thereof, washing power will increase in the selected rotational position interval ensuring that the heavily soiled item is sufficiently washed.

As a further example, if a user has placed a delicate item such as a painted tableware at a position in the wash chamber corresponding to the position of the satellite spray device illustrated in FIG. 2*b*, the user may select a rotational position interval corresponding to the position of the delicate item and select a decrease of pumping intensity in the rotational position interval. In response thereto, the control unit will decrease pumping intensity when the estimated current rotational position of the satellite spray device 7 is within the selected rotational position interval, and the washing power will decrease in the selected rotational position interval. As a result, a more gentle washing of the delicate item is performed than of items placed outside of the selected rotational position interval.

As an even further example, if a user has placed a heavily soiled item at a position in the wash chamber 3 corresponding to the position of the satellite spray device 7 illustrated in FIG. 2*b*, and a delicate item such as a painted tableware at a position in the wash chamber corresponding to the position of the satellite spray device illustrated in FIG. 2*a*, the user may select a first rotational position interval corresponding to the position of the heavily soiled item and select an increase of pumping intensity in the first rotational position interval. The user may also select a second rotational position interval corresponding to the position of the delicate item and select a decrease of pumping intensity in the second rotational position interval. In response thereto, the control unit will increase pumping intensity when the estimated current rotational position of the satellite spray device 7 is within the selected first rotational position interval and decrease pumping intensity when the estimated current rotational position of the satellite spray device 7 is within the selected second rotational position interval. As a result, the dishwasher will perform simulations washing of items of different type with different wash requirements in a simple and effective manner, where the heavily soiled items can be washed with an intensity sufficiently to make them clean whilst washing delicate items gently enough not to damage them.

According to the embodiments illustrated in FIG. 1, the dishwasher 1 comprises a first communication unit 23 connected to the control unit 15. The first communication unit 23 is arranged to wirelessly communicate with a second communication unit 25. The wireless communication may be performed over a wireless connection such as a the internet, or a wireless local area network (WLAN), or a wireless connection for exchanging data over short distances using short-wavelength, i.e. ultra-high frequency (UHF) radio waves in the industrial, scientific and medical (ISM) band from 2.4 to 2.485 GHz. The second communication unit 25 comprises a user interface 26 for selecting the at least one selected rotational position interval. The second communication unit 25 is further configured to generate a signal representative of the at least one selected rotational position interval and to send the signal to the first communication unit 23 of the dishwasher 1.

The first communication unit 23 is configured to receive a signal from the second communication unit 25. As mentioned, the signal is representative of the at least one selected rotational position interval. In addition, the signal may further be representative of whether an increase or decrease is to be performed of the pumping intensity within the at least one selected rotational position interval, as well as a level of such an increase or such a decrease of the pumping intensity. The second communication unit 25 may be a stationary or portable communication unit, such as a computer, a tablet computer or a smartphone. The second communication unit 25 may comprise a display and a control unit where the control unit is configured to output an image on the display of the second communication unit 25 with a field representative of rotational position intervals of the wash arm 5 within the wash camber. In such embodiments, a user may select one or more rotational position intervals and select an increase or decrease in one or more rotational position intervals as well as a level of increase or decrease in one or more rotational position intervals. Then, the second communication unit 25 may send the signal to the first communication unit 23 which is configured to receive the signal and on the basis of the received signal, the control unit 15 is configured to increase or decrease pumping intensity of the pump 11 when the estimated current rotational position is within at least one selected rotational position interval.

It is to be understood that the foregoing is illustrative of various example embodiments and that the invention is defined only by the appended claims. A person skilled in the art will realize that the example embodiments may be modified, and that different features of the example embodiments may be combined to create embodiments other than those described herein, without departing from the scope of the present invention, as defined by the appended claims. For example, the at least one sensor 13.1, 13.2 configured to sense a rotational position of the wash arm may comprise a magnetic sensor as mentioned above, but may also comprise another type of sensor configured to sense a rotational position of the wash arm such as an ultrasonic sensor, a microphone, etc.

Further, in the embodiments of the dishwasher 1 illustrated in FIG. 1, the wash arm arrangement 4 is illustrated as a lower wash arm arrangement arranged below a lower rack of the dishwasher. However, the wash arm arrangement 4 may constitute a middle wash arm arrangement arranged between a lower rack and an upper or middle rack. Further, the wash arm arrangement 4 may constitute an upper wash arm arrangement arranged above a top rack of the dishwasher 1. In addition, the dishwasher 1 may comprise two or more wash arm arrangements 4 arranged at different positions within the washing chamber 3.

As used herein, the term "comprising" or "comprises" is open-ended, and includes one or more stated features, elements, steps, components or functions but does not preclude the presence or addition of one or more other features, elements, steps, components, functions or groups thereof.

The invention claimed is:

1. A dishwasher comprising:

a washing chamber;

a wash arm arrangement comprising a wash arm rotatably arranged in the washing chamber, and a satellite spray device arranged on the wash arm, wherein the wash arm arrangement includes a plurality of nozzles, the dishwasher comprises a pump fluidically connected to the plurality of nozzles, the pump is configured to pump washing liquid through the plurality of nozzles into the washing chamber, the dishwasher comprises at least one proximity sensor configured to sense a rotational position of the wash arm each time the wash arm passes by the least one proximity sensor during rotation, and the dishwasher further comprises a control unit configured to:

calculate a rotational speed of the wash arm based on an elapsed time between consecutive sensed rotational positions and a known rotational distance that the wash arm travels between the consecutive sensed rotational positions, estimate a current rotational position of the wash arm away from the least one proximity sensor based on an elapsed time since a previously sensed rotational position and the calculated rotational speed, adapt pumping intensity of the pump based on the estimated current rotational position of the wash arm, and increase or decrease pumping intensity of the pump when the estimated current rotational position is within at least one selected rotational position interval.

2. The dishwasher according to claim 1, wherein at least one nozzle of the plurality of nozzles is arranged to direct the washing liquid in directions causing the wash arm to rotate within the washing chamber.

3. The dishwasher according to claim 2, wherein the wash arm is configured to continuously rotate within the washing chamber when the pump is pumping washing liquid through the at least one nozzle of the plurality of nozzles.

4. The dishwasher according to claim 1, wherein the satellite spray device is rotatably arranged around a satellite spray device axis on the wash arm, and wherein nozzles of the satellite spray device are arranged to direct the washing liquid in directions causing the satellite spray device to rotate around the satellite spray device axis.

5. The dishwasher according to claim 1, wherein the number of nozzles and/or sizes of nozzles on the satellite spray device and the wash arm are arranged such that a flowrate of washing liquid pumped through the nozzles of the satellite spray device is higher than a flowrate of washing liquid pumped through the nozzles of the wash arm.

6. The dishwasher according to claim 1, wherein the wash arm comprises a magnet and the at least one sensor comprises at least one magnetic sensor configured to sense the rotational position of the wash arm by sensing a magnetic field of the magnet.

7. The dishwasher according to claim 1, wherein the dishwasher comprises one sensor only, configured to sense a rotational position of the wash arm.

8. The dishwasher according to claim 1, wherein the dishwasher comprises a user interface for selecting the at least one selected rotational position interval.

9. The dishwasher according to claim 1, comprising a first communication unit connected to the control unit, wherein the first communication unit is arranged to wirelessly communicate with a second communication unit comprising a user interface for selecting the at least one selected rotational position interval.

10. The dishwasher according to claim 9, wherein the second communication unit is a stationary or portable communication unit, such as a computer, a tablet computer or a smartphone.

11. The dishwasher of claim 1, wherein the at least one sensor is mounted in at least one fixed position in the washing chamber to detect the wash arm at the consecutive sensed rotational positions each time the wash arm passes the at least one sensor.

12. The dishwasher of claim 1, wherein the wash arm continuously rotates throughout the at least one selected rotational position interval in an instance the pumping intensity is increased or decreased.

13. The dishwasher of claim 1, wherein the pumping intensity of the pump is increased or decreased in the at least one selected rotational position interval for a plurality of consecutive full rotations of the wash arm.

14. The dishwasher of claim 1, wherein the control unit is further configured to decrease the pumping intensity of the pump based on the estimated current rotational position of the wash arm.

15. The dishwasher of claim 1, wherein the control unit is further configured to decrease the pumping intensity of the pump when the estimated current rotational position is within the at least one selected rotational position interval.

16. The dishwasher of claim 1, wherein each sensor of the at least one sensor is configured to detect the rotational position of the wash arm during each rotation of the wash arm.

17. The dishwasher of claim 1, wherein the at least one sensor comprises a first sensor and a second sensor, and wherein the first sensor is configured to detect the wash arm at a first rotational position during each rotation of the wash arm and the second sensor is configured to detect the wash arm at a second rotational position different than the first rotational position during each rotation of the wash arm.

18. The dishwasher of claim 1, wherein each sensor of the at least one sensor is disposed at a respective particular rotational position of the wash arm, such that each sensor is configured to detect the rotational position of the wash arm at the respective particular rotational position.

* * * * *